US006338430B1

(12) United States Patent
Cheng

(10) Patent No.: US 6,338,430 B1
(45) Date of Patent: Jan. 15, 2002

(54) DECORATIVE HOUSING FOR A STAPLER

(76) Inventor: Chiu-Ju Cheng, No. 2-1, Lane 52-1, Sec. 2, Yuan-Ti Rd., Ta-Li City, Taichung Hsien (TW)

( * ) Notice: Subject to any disclaimer, the term of this patent is extended or adjusted under 35 U.S.C. 154(b) by 0 days.

(21) Appl. No.: 09/901,781

(22) Filed: Jul. 9, 2001

(51) Int. Cl.[7] ..... B25C 5/02
(52) U.S. Cl. ..... 227/134; 227/156; D8/49
(58) Field of Search ..... 227/156, 134, 227/120; D8/49, 50

(56) References Cited

U.S. PATENT DOCUMENTS 4,014,493 A * 3/1977 Wolfe ..... 227/156
4,278,017 A * 7/1981 Conjura ..... 227/156
4,727,610 A * 3/1988 Lin ..... 227/156
5,690,268 A * 11/1997 Evans et al. ..... 227/156
5,797,535 A * 8/1998 Lovegrove et al. ..... 227/134
6,152,347 A * 11/2000 Wilson et al. ..... 227/134

* cited by examiner

*Primary Examiner*—Scott A. Smith
(74) *Attorney, Agent, or Firm*—Kolisch Hartwell Dickinson, McCormack & Heuser

(57) ABSTRACT

A decorative housing for a stapler includes a casing and a bottom plate. The casing includes a first cavity defined in a front portion of the casing to receive a press cover of a stapler and a second cavity defined in a rear portion of the casing. A cover is attached to the casing to close the second cavity. At least two liquids with different specific gravity are injected into and fill the second cavity. The liquids do not mix with each other. Multiple floating objects float on the interface of the liquids. The decorative housing for a stapler can promote visual appearance and add value to the conventional stapler.

11 Claims, 3 Drawing Sheets

DECORATIVE HOUSING FOR A STAPLER

BACKGROUND OF THE INVENTION

1. Field of the Invention

The present invention relates to a decorative housing, and more particularly to a decorative housing for a stapler.

2. Description of Related Art

A conventional stapler in accordance with the prior art comprises a support base, a guide base with one end pivotally attached to a rear end of the support base, a staple magazine mounted in the guide base and a press cover with one end pivotally attached to the rear end of the support base. However, the conventional stapler has a mundane and unattractive appearance that needs to be advantageously altered.

The present invention has arisen to mitigate and/or obviate the disadvantages of the conventional stapler.

SUMMARY OF THE INVENTION

The main objective of the present invention is to provide a decorative housing for a stapler. The decorative housing for a stapler in accordance with the present invention includes a casing and a bottom plate. The casing includes a first cavity defined in a front portion of the casing to receive a press cover of a stapler and a second cavity defined in a rear portion of the casing. A cover is attached to the casing to close the second cavity. At least two liquids with different specific gravity are injected into and fill the second cavity. The liquids do not mix with each other. Multiple floating objects float on the interface between the liquids to promote the visual appearance of the stapler.

Further benefits and advantages of the present invention will become apparent after a careful reading of the detailed description with appropriate reference to the accompanying drawings.

DETAILED DESCRIPTION OF THE INVENTION

Figure 1:
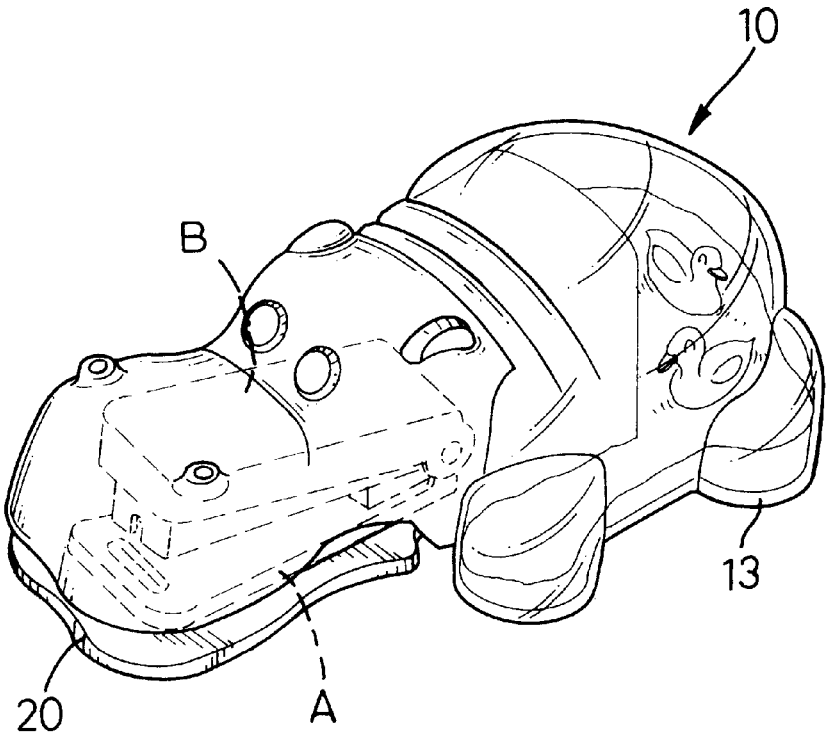
FIG. 1 is a perspective view of a decorative housing for a stapler in accordance with the present invention.
Figure 3:
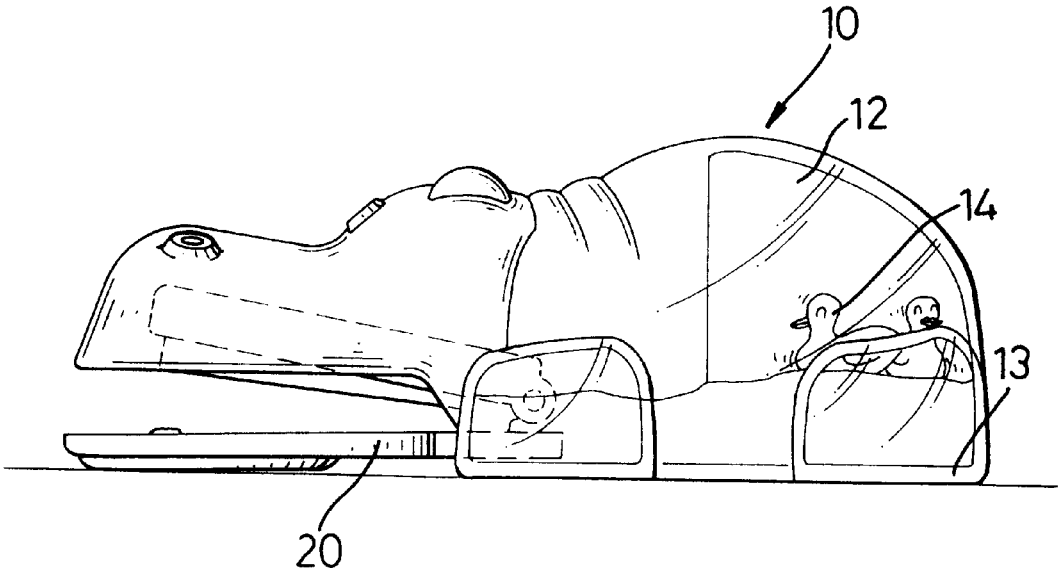
FIG. 3 is a side plan view of the decorative housing for a stapler in FIG. 1.
Figure 2:
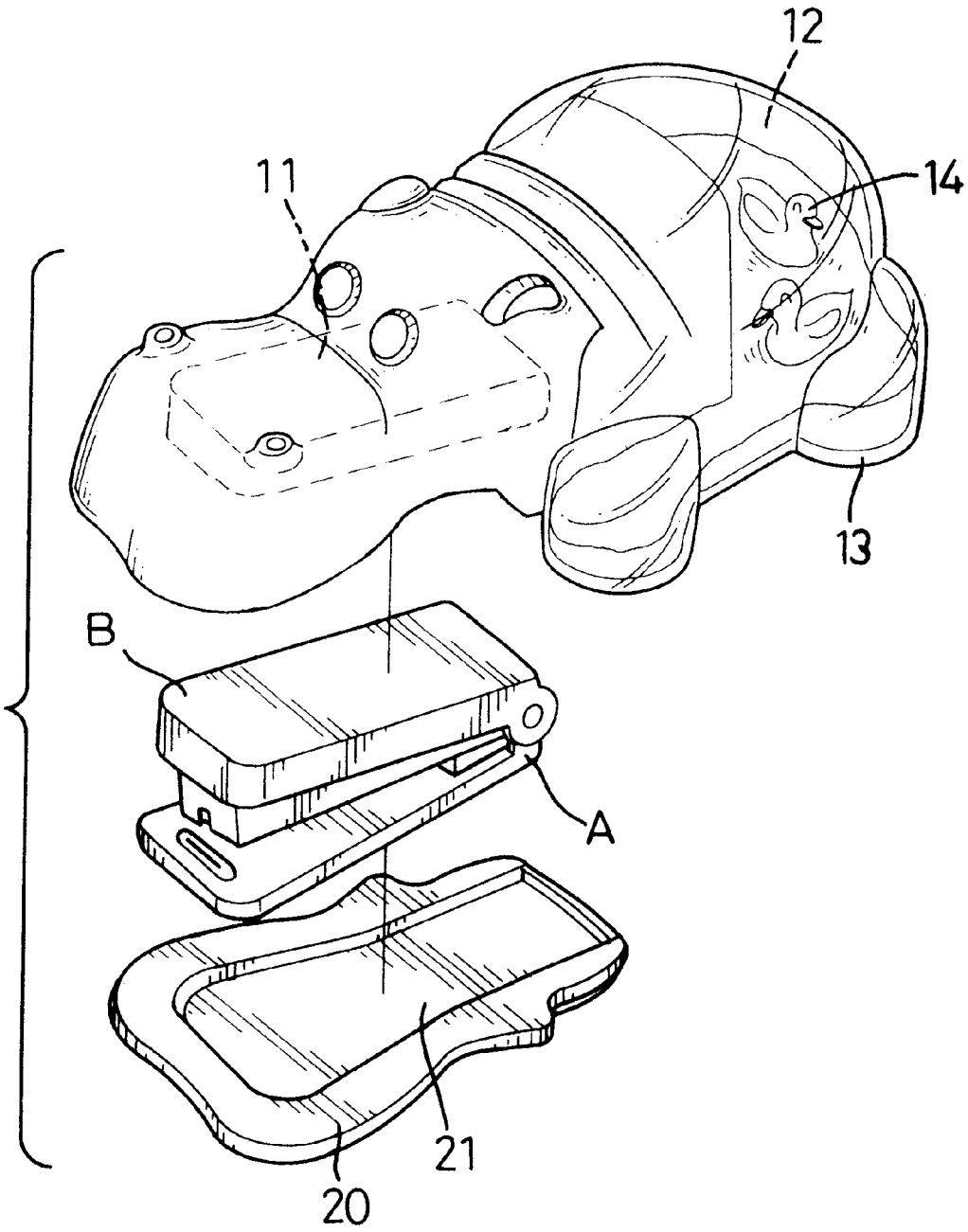
FIG. 2 is a partially exploded perspective view of the decorative housing for a stapler in FIG. 1.

With reference to the drawings and initially to FIGS. 1 to 3, a decorative housing for a stapler in accordance with the present invention comprises a transparent casing (10) and a bottom plate (20). The stapler includes a support base (A) and a press cover (B). One end of both the support base (A) and the press cover (B) are pivotally attached to each other. The transparent casing (10) is adapted to be mounted on the press cover (B), and the bottom plate (20) is adapted to be attached to the support base (A) of the stapler.

The casing (10) is formed in an animal shape, such as a hippopotamus, turtle, alligator, etc., and comprises a first cavity (11) and a second cavity (12). The first cavity (11) is defined in a front portion of the casing (10) to receive the press cover (B) of the stapler, and the second cavity (12) defined in a rear portion of the casing (10). A cover (13) is attached to the casing (10) to close the second cavity (12). At least one liquid is injected into and the second cavity (12). Multiple floating objects (14) float on the surface of the liquid. In the preferred embodiment of the present invention, there are two liquids with different specific gravity injected into and fill the second cavity (12). The liquids used in the decorative housing for a stapler in accordance with the present invention are colored and do not mix with each other. One of the liquids is colored water and the other is oil. Multiple floating objects (14) float on the interface of the water and the oil. The floating objects are formed in animal shapes such as ducks, turtles, etc. to promote visual appearance. A weight (not shown) is attached to a bottom of the floating object to make the floating object always standing upright.

The bottom plate (20) includes a recess (21) defined in one side facing the casing (10). The recess (21) is adapted to receive the support base (A) of the stapler.

Figure 4:
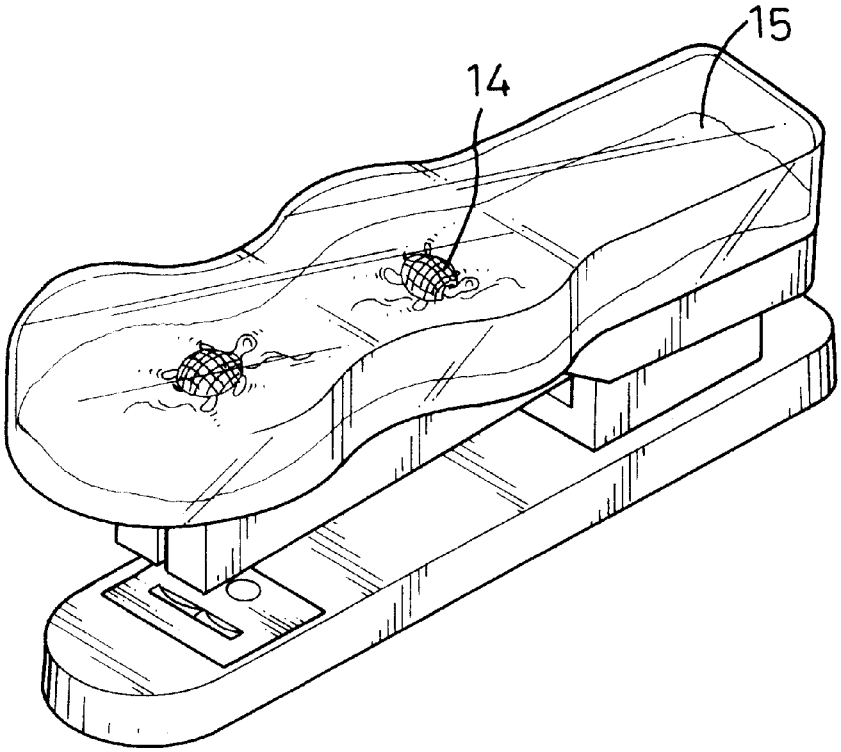
FIG. 4 is a perspective view of another embodiment of the decorative housing for a stapler in accordance with the present invention.
Figure 5:
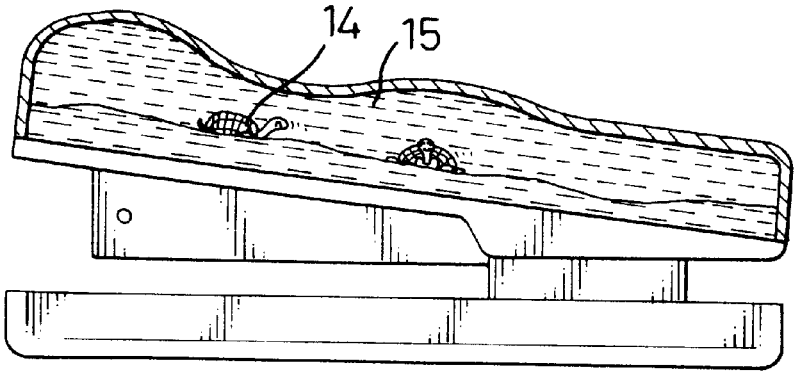
FIG. 5 is a side plan view of the decorative housing for a stapler in FIG. 4.

With reference to FIGS. 4 and 5 that show another embodiment of the decorative housing for a stapler in accordance with the present invention. The casing (10) comprises a first cavity (not shown) defined in a lower portion of the casing to receive the press cover (B) of the stapler and a second cavity (15) defined in a upper portion of the casing (10) to receive liquid. A cover (not shown) is attached to the casing (10) to close the second cavity (15). At least one liquid is injected into second cavity (15). In the preferred embodiment, there are two liquids with different specific gravity rejected into and fill the second cavity (15). The liquids used in the decorative housing for a stapler in accordance with the present invention are colored and do not mix with each other. One of the two liquids is water and the other is oil. Multiple floating objects (14) float on the interface of the two liquids. The floating objects are formed in animal shapes such as ducks, turtles, etc to promote the visual appearance. A weight (not shown) is attached to a bottom of the floating object to make the floating object always standing upright.

To assemble the decorative housing for a stapler in accordance with the present invention, the floating object (14) is put into the second cavity (12) of the casing (10) and the cover (13) is attached to the casing (10) to close the second cavity (12) of the casing (10). The cover (13) has a bore (not shown) defined to allow the liquids to be injected into the second cavity (12) of the casing (10). A plug (not shown) is securely inserted into the bore in the cover (13) to prevent the liquids from leaking out of the second cavity (12) in the casing (10).

The decorative housing for a stapler in accordance with the present invention can promote the visual appearance and add value to the conventional stapler.

Although the invention has been explained in relation to its preferred embodiment, it is to be understood that many other possible modifications and variations can be made without departing from the spirit and scope of the invention as hereinafter claimed.

What is claimed is:

1. A decorative housing for a stapler that has a support base and a press cover pivotally attached to each other, comprising:

a transparent casing including:

a first cavity defined in the casing and adapted to received the press cover of the stapler;

a second cavity defined in the casing; and a cover attached to the casing to close the second cavity;

at least one liquid injected into the second cavity; and multiple floating object floating on an interface of the liquid to promote visual appearance, the floating object having a weight attached to a bottom of the floating object to keep the floating object standing upright.

2. The decorative housing for a stapler as claimed in claim 1, wherein the first cavity is defined in a front portion of the casing and the second cavity is defined in a rear portion of the casing.

3. The decorative housing for a stapler as claimed in claim 2, wherein two liquids with different specific gravity are injected into and fill the second cavity, and the multiple floating objects float on the interface of the two liquids.

4. The decorative housing for a stapler as claimed in claim 3, wherein one of the liquids is water and the other is oil.

5. The decorative housing for a stapler as claimed in claim 4, wherein the water is colored.

6. The decorative housing for a stapler as claimed in claim 1, wherein the first cavity is defined in a lower portion of the casing and the second cavity is defined in a upper portion of the casing.

7. The decorative housing for a stapler as claimed in claim 1 further comprising a bottom plate adapted to be attached to the support base of the stapler.

8. The decorative housing for a stapler as claimed in claim 7, wherein the bottom plate comprises a recess defined in one side of the bottom plate facing the casing, and the recess in the bottom plate adapted to receive the support base of the stapler.

9. The decorative housing for a stapler as claimed in claim 1, wherein two liquids with different specific gravity are injected into and fill the second cavity, and the multiple floating objects float on the interface of the two liquids.

10. The decorative housing for a stapler as claimed in claim 9, wherein one of the liquids is water and the other is oil.

11. The decorative housing for a stapler as claimed in claim 10, wherein the water is colored.

* * * * *